US006375482B1

(12) United States Patent
Fan

(10) Patent No.: US 6,375,482 B1
(45) Date of Patent: Apr. 23, 2002

(54) ELECTRICAL CARD CONNECTOR WITH SWITCH

(75) Inventor: Chia Hao Fan, Shu-Lin (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/752,404

(22) Filed: Dec. 27, 2000

(30) Foreign Application Priority Data

Dec. 15, 2000 (TW) ..... 89221829

(51) Int. Cl.[7] ..... H01R 29/00
(52) U.S. Cl. ..... 439/188; 439/489
(58) Field of Search ..... 439/188, 489, 439/630, 488, 631–637; 235/441

(56) References Cited

U.S. PATENT DOCUMENTS 6,120,310 A * 9/2000 Chang ..... 439/188
6,126,464 A * 10/2000 Chang ..... 439/188
6,129,570 A * 10/2000 Griffin et al. ..... 439/188
6,135,809 A * 10/2000 Asakawa ..... 439/489

* cited by examiner

*Primary Examiner*—Hien Vu
(74) *Attorney, Agent, or Firm*—Wei Te Chung

(57) ABSTRACT

An electrical card connector (1) includes a housing (10) receiving a plurality of terminals (11) therein, a frame (12) which is slidably engagable with the housing for supporting an electrical card (2), and a switch device (13) for detecting full insertion of the electrical card. The housing comprises a block (102) protruding beyond a front face thereof for retaining the switch device thereto. The switch device has a switch mounting clip (131) with a base (132) soldered to a printed circuit board (PCB) (3). A spring switch lever (134) protrudes from the switch mounting clip and has a curved upper contact portion (135) and a curved lower contact portion (138) extending from a lower side of the upper contact portion for electrically connecting with the PCB when the electrical card reaches a full insertion position.

3 Claims, 3 Drawing Sheets

ELECTRICAL CARD CONNECTOR WITH SWITCH

FIELD OF THE INVENTION

The present invention relates to an electrical card connector used for mobile communications, and particularly to an electrical card connector having a switch assembly for detecting full insertion of a smart card.

BACKGROUND OF THE INVENTION

Electrical card connectors are popularly used in mobile communications for connecting electrical cards to printed circuit boards. Conventional electrical card connectors are disclosed in U.S. Pat. Nos. 6,099,335, 6,0393,599, 6,086,426 and 6,132,229. Each of the conventional electrical card connectors has a dielectric housing receiving a plurality of terminals and has at least two cooperating switch contacts for detecting full insertion of an electrical card. The switch contacts are normal closed contacts, which are connected together initially before insertion of a card. The contacts are separated from each other (opened) in response to insertion of the electrical card, thereby achieving the function of detecting full insertion of the electrical card into the electrical card connector.

However, this design requires at least two switch contacts, which utilizes more components and has a higher cost. The larger number of switch contacts adds to the manufacturing process.

Hence, an improved electrical card connector is needed to overcome the above-mentioned deficiencies of current electrical card connectors.

SUMMARY OF THE INVENTION

Accordingly, the primary object of the present invention is to provide an electrical card connector with a one-piece switch for detecting full insertion of an electrical card.

An electrical card connector in accordance with the present invention comprises a dielectric housing, a plurality of terminals mounted in the housing, a frame slidably engagable with the housing and adapted for supporting an electrical card therein, and a switch device for detecting full insertion of an electrical card. The housing comprises a block for retaining the switch device. The frame forms a push rod at a front end of a side thereof for actuating the switch device. The switch device has a switch mounting clip which attaches to the block of the housing and has a base for soldering to a solder pad on a printed circuit board (PCB). The switch device also has a spring switch lever having a curved upper contact portion and a curved lower contact portion extending from a lower side of the upper contact portion for electrically connecting with a gold finger on the PCB when the electrical card is fully inserted into the electrical card connector.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
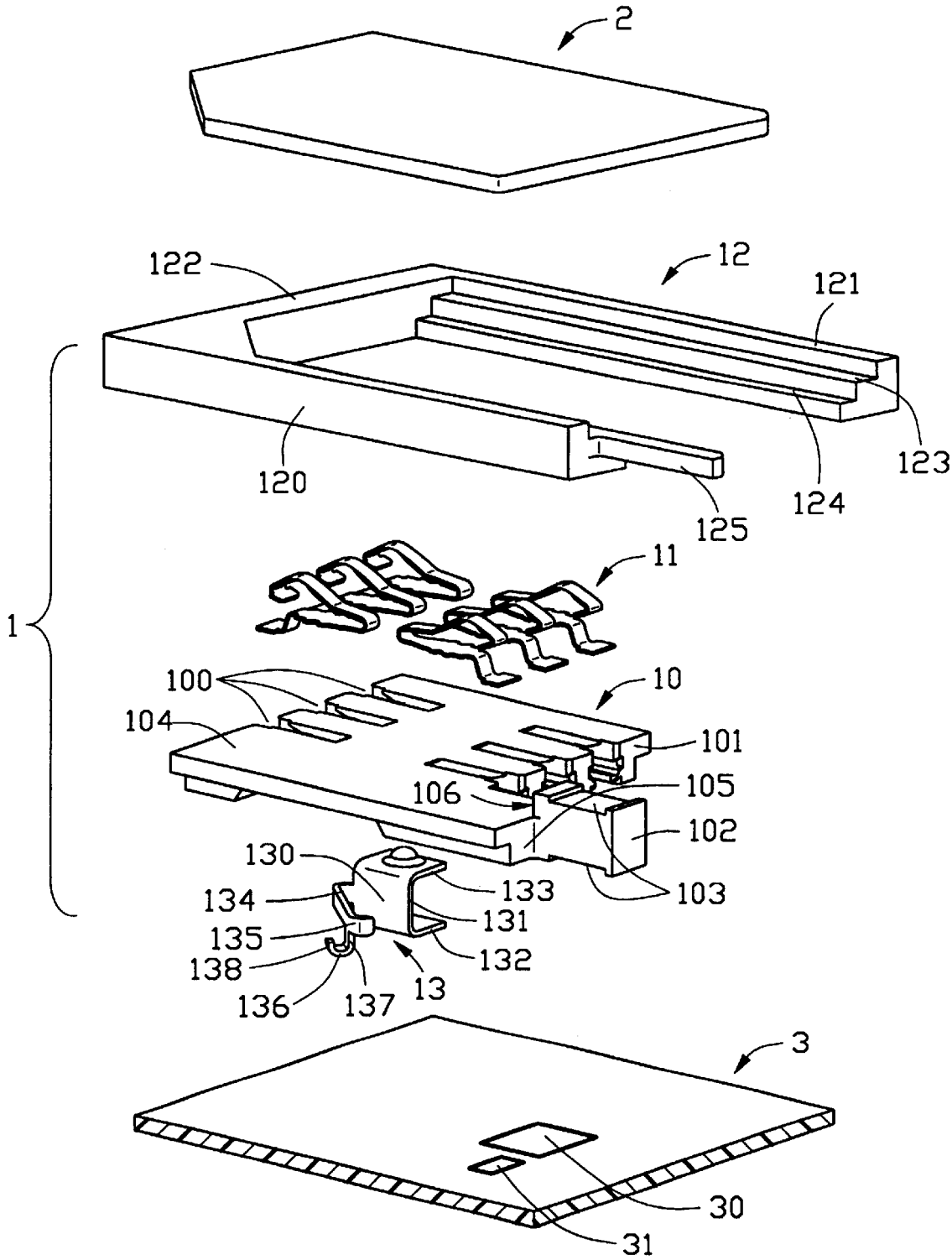
FIG. 1 is an exploded view of an electrical card connector in accordance with the present invention, shown with a portion of a printed circuit board (PCB) and an electrical card.
Figure 2:
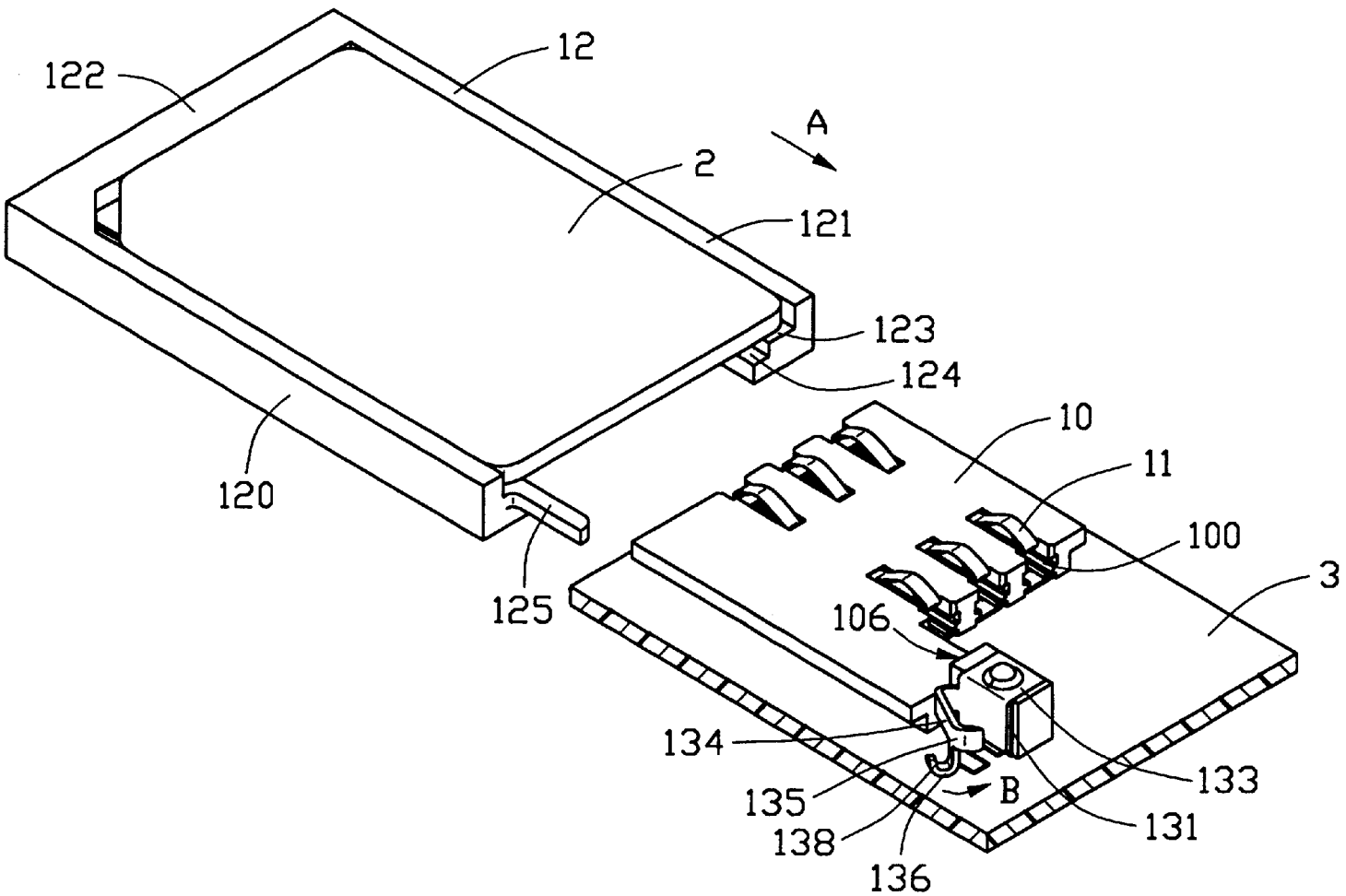
FIG. 2 is a partly-assembled view of FIG. 1 wherein the electrical card is inserted into a frame of the electrical card connector and stationary elements of the electrical card connector are mounted on the PCB.

Referring to FIGS. 1–2, an electrical card connector 1 in accordance with the present invention comprises a housing 10, a plurality of terminals 11, a frame 12 and a switch device 13.

The housing 10 comprises two rows of passageways 100 defined through the housing 10 from top to bottom at two ends thereof for receiving corresponding terminals 11. Since the structure and function of the passageways 100 and the terminals 11 are well known to those skilled in the art, a detailed description thereof is omitted herein. Aside portion 104 is formed on a side of the housing 10 which forwardly extends beyond a front surface 101 of the housing 10. A block 102 extends from a front face 105 of the side portion 104 beside the passageways 100 and has a rear face 106 coplanar with the front face 105 of the housing 10. A pair of rectangular cutouts 103 is defined in an upper and a lower surfaces of the block 102.

The switch device 13 is for detecting full insertion of the card 2. It has a U-shaped switch mounting clip 131 and a spring switch lever 134 laterally and forwardly extending from a rear edge of the switch mounting clip 131. The switch mounting clip 131 has a base 132 for electrically connecting the switch device 13 to a solder pad 30 on a printed circuit board (PCB) 3. A vertical arm 130 vertically extends from an edge of the base 132, and a top arm 133 extends from a top edge of the vertical arm 130 and parallel to the base 132. The spring switch lever 134 has a curved upper contact portion 135 at a front end thereof which curves toward the vertical arm 130. A curved lower contact portion 138 depends from a connecting bar 137 which intermediates between the upper contact portion 135 and the lower contact portion 138. The lower contact portion 138 has a substantially planar contacting face 136 at a lowermost end thereof for electrically contacting a gold finger 31 mounted on the PCB 3 near the solder pad 30.

The frame 12 includes a first and a second arms 120, 121 opposite to each other and a third arm 122 connecting rear ends of the first and second arms 120, 121. Each arm 120, 121 has a stepped cross-section, the steps descending toward an inward side of the first and second arms 120, 121. The steps define an upper and a lower channels 123, 124 for respectively receiving the electrical card 2 and two sides of the housing 10 therein. A push rod 125 is integrally molded with and forwardly extends from a front face (not labeled) of the first arm 120.

In assembly, the terminals 11 and the switch device 13 are attached to the housing 10, and bases (not labeled) of the terminals 11 and the base 132 of the switch mounting clip 131 are respectively soldered to pads (not shown) and to the solder pad 30 of the PCB 3. The spring switch lever 134 is at an open position, which is distant from the gold finger 31 on the PCB 3, before the frame 12 is assembled on the housing 10 and the PCB 3.

Figure 3:
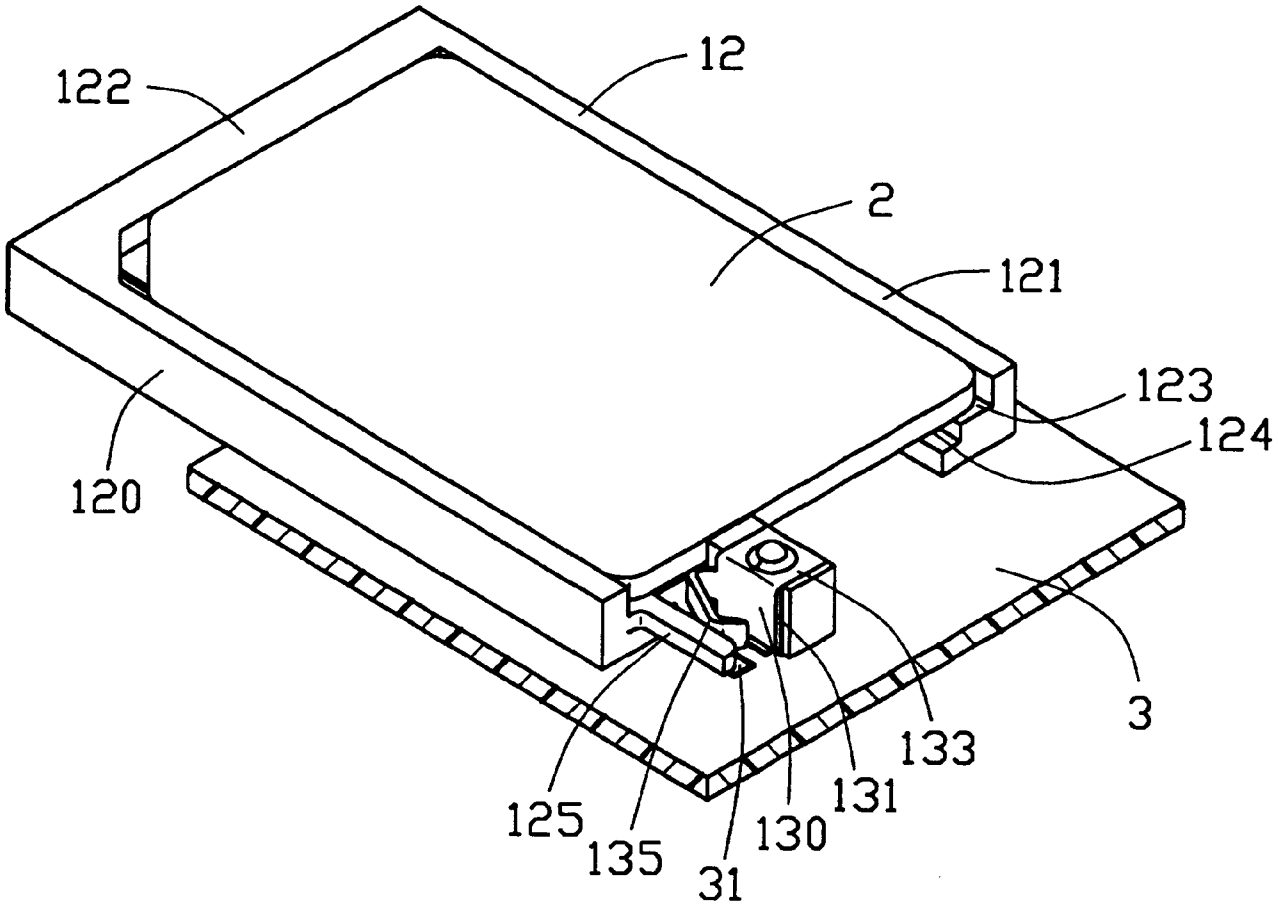
FIG. 3 is a view similar to FIG. 2, wherein the electrical card is fully inserted into the electrical card connector.

Referring to FIGS. 2–3, in use, the electrical card 2 is inserted into the upper channel 123 formed by the frame 12. When the frame 12 is placed behind the housing 10 and is pushed forward in the direction of the arrow A shown in FIG.

2, the two sides of the housing 10 slide into the lower channel 124, the push rod 125 moves forward to push against the upper contact portion 135 of the switch device 13. The lower contact portion 138 is moved in the direction of the arrow B, toward the gold finger 31 on the PCB 3. Finally, the electrical card 2 engages with the rear face 106 of the block 102, and the contacting face 136 of the lower contact portion 138 electrically connects with the gold finger 31 on the PCB 3. Thus, the spring switch lever 134 is at a closed position, and the electrical card 2 is fully inserted into the electrical card connector 1.

While the present invention has been described wih reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An electrical connector adapted for interconnection between an electrical card and a printed circuit board (PCB), comprising:

a dielectric housing having a block protruding beyond a front face thereof;

a plurality of terminals received in the housing;

a switch device including a switch mounting clip retained to the block of the housing, and a switch lever extending from the switch mounting clip and adapted for engaging with the PCB when the electrical card reaches a full insertion position; and a frame slidably engagable with the housing and adapted for retaining the electrical card therein, the frame having an integral push rod extending outwardly from a front side thereof and said rod being parallel with the electrical card for horizontally biasing the switch lever of the switch device to contactingly wipe over a gold finger of the PCB; wherein the frame has a first arm and a second arm opposite to each other and the two arms together therebetween define an upper channel for receiving the card and a lower channel for engaging with two sides of the housing.

2. The electrical connector in accordance with claim 1, wherein said switch mounting clip has a base soldered to a solder pad on the PCB.

3. The electrical connector in accordance with claim 1, wherein the switch lever comprises a curved upper contact portion and a lower contact portion extending from a lower side of the upper contact portion for connecting with the gold finger on the PCB when the electrical card reaches a full insertion position.

* * * * *